US006755335B2

(12) United States Patent
Fielitz

(10) Patent No.: US 6,755,335 B2
(45) Date of Patent: Jun. 29, 2004

(54) GAS-OPERATED SETTING TOOL

(75) Inventor: Harald Fielitz, Lindau (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/462,235

(22) Filed: Jun. 16, 2003

(65) Prior Publication Data

US 2003/0230620 A1 Dec. 18, 2003

(30) Foreign Application Priority Data

Jun. 17, 2002 (DE) ..... 102 26 878

(51) Int. Cl.[7] ..... B25C 1/08
(52) U.S. Cl. ..... 227/10; 227/130; 123/46 SC
(58) Field of Search ..... 227/8, 9, 10, 130; 123/630, 406.47, 46 SC

(56) References Cited

U.S. PATENT DOCUMENTS 5,415,136 A * 5/1995 Doherty et al. ..... 123/46 SC
5,911,350 A * 6/1999 Bolger et al. ..... 227/2
6,102,270 A * 8/2000 Robinson ..... 227/10
6,145,724 A * 11/2000 Shkolnikov et al. ..... 227/8
6,179,192 B1 * 1/2001 Weinger et al. ..... 227/8
6,247,626 B1 * 6/2001 MacVicar ..... 227/10

* cited by examiner

*Primary Examiner*—Scott A. Smith
(74) *Attorney, Agent, or Firm*—Sidley Austin Brown & Wood, LLP

(57) ABSTRACT

A gas-operated setting tool for in fastening elements includes a combustion chamber (20), a piston displaceable in the tool guide cylinder under pressure generated as a result of the combustion of the air-fuel mixture in the combustion chamber (20), a scavenging chamber (30) adapted to be filled with scavenging air and pneumatically connected with the combustion chamber, and at least one slide member (31) for discharging the scavenging air from the scavenging chamber toward the combustion chamber.

10 Claims, 7 Drawing Sheets

GAS-OPERATED SETTING TOOL

BACKGROUND OF THE INVENTION

1. Field of the Invention

The present invention relates to a setting tool for driving fastening elements, such as nail, bolts, pins, etc . . . in a constructional component and includes a combustion chamber in which combustion of an air-fuel mixture takes place, a guide cylinder adjoining the combustion chamber, and a piston displaceable in the guide cylinder under pressure generated as a result of the combustion of the air-fuel mixture in the combustion chamber.

2. Description of the Prior Art

Setting tools of the type described above are operated by gaseous or liquid fuel that is evaporated before combustion. The setting energy for driving in a fastening element is produced by combustion in the tool combustion chamber of a gas-air mixture and is transmitted to the fastening element by a piston.

U.S. Pat. No. 4,365,471 discloses a setting tool in which the combustion space is divided in at least two chambers separated by a plate in which overflow openings are provided. During a setting process, the combustion of an air-gas mixture starts in a first chamber provided with an ignition device. After the ignition, the flame front expand with a comparatively low speed in the first chamber, displacing the non-combusted gas-air mixture toward the chamber wall and which flows through the overflow openings into next chamber, producing in the next chamber turbulence and precompression. As soon as the flame front reaches the overflow openings, the flame jets that flow therethrough are accelerated due to the small cross-section of the openings, creating in the next chamber a further turbulence. The intermixed, turbulent gas-air mixture in the second chamber is ignited over the entire surface of the flame jets. It burns with a high speed which provides for a high effectiveness of combustion as the losses due to cooling are very small. The scavenging of the combustion space is effected with an additional device with which the waste gas is evacuated and fresh air is fed.

German Patent DE 40 32 202 C2, from which the present invention proceeds, discloses a setting tool that operates on a principle of a divided combustion chamber according to U.S. Pat. No. 4,365,471. In the setting tool of the German Patent, however, the chambers of the combustion space are separated from each other by a displaceable intermediate or separation plate and are limited toward the rear by a displaceable cylindrical top plate. For evacuating of the waste gases from the combustion space, the cylindrical top plate and the separation plate are displaced toward the bottom of the combustion space, reducing the remaining combustion volume and expelling the waste gases out of the tool. The combustion space is filled with air upon expansion of combustion chambers when the setting tool is pressed against a constructional component.

The drawback of the foregoing setting tools consists in that the volume of the chambers or of the combustion space cannot be reduced to an absolute zero. Therefore, a complete scavenging of the combustion space does not take place with a single displacement step. Rather, in one or more chambers, a certain amount of the waste gas, which depends on the volume of remaining slots, bores, and other so-called dead volumes, remains. The remaining waste gas mixes with air when the air is aspirated and adversely affects the concentration of the mixture and thereby the amount of energy produced by combustion.

Accordingly, an object of the present invention is a setting tool of type in which the waste gas is completely expelled.

SUMMARY OF THE INVENTION

This and other objects of the present invention, which will become apparent hereinafter, are achieved by providing means for forming a scavenging chamber adapted to be filled with scavenging air and pneumatically connected with the combustion chamber, the forming means including at least one slide member for discharging the scavenging air from the scavenging chamber toward the combustion chamber.

The present invention provides a scavenging chamber that can be filled with outside air before or after the setting process and which is at least partially pneumatically connected with the combustion chamber. There is provided, according to the present invention at least one slide member that forces the air out of the scavenging chamber, through the combustion chamber, and in the atmosphere. This measures provides for scavenging of the combustion chamber and cleaning it from possibly still filling it, waste gases. The scavenging air can be introduced, e.g., already during the setting process by suitable means into the scavenging chamber, and after the setting process has been finished, the air from the scavenging chamber can be forced out with the slide member and be introduced into the combustion chamber. An additional electrical drive, e.g., for a ventilator, can be eliminated. Moreover, providing a scavenging chamber capable to be filled with scavenging air, insure a complete scavenging of the combustion chamber.

According to an advantageous embodiment of the present invention, the combustion chamber is divided in at least two chamber section by a separation plate. After completion of the setting process, the volume of the combustion chamber is reduced at least in one of the chamber sections by displacement of the separation plate in the setting direction which results in evacuation of a major portion of the residual waste gas from the combustion chamber or at least from the one of the chamber sections the volume of which is being reduced. Simultaneously, with the reduction of the volume of the combustion chamber, the scavenging chamber for receiving the scavenging air, the front, in the setting direction, end of which is limited by the separation plate and the rear end of which is limited by the slide member expands. The filling of the scavenging chamber with the air is effected through channels formed in the setting tool housing. In this embodiment, the scavenging chamber can be easily filled with outside air as a result of displacement of the separation plate which is displaced either as result of cooling of the fuel gases or by an additional spring means that applies a biasing force to the separation plate acting in the setting direction. When the scavenging chamber is filled with the outside air after the completion of the setting process, the heating of the scavenging air is substantially prevented, and the scavenging of the combustion chamber is effected with a relatively cold and dense air.

Advantageously, the slide member is axially displaceably arranged in the setting tool, and the scavenging air is forced out of the scavenging chamber as a result of displacement of the slide member in the setting direction.

A simple and place-saving construction of the setting tool is obtained when the slide member is also formed as a plate extending parallel to the separation plate.

According to a further advantageous embodiment of the present invention, the scavenging of the residual volume of the combustion chamber is effected only after the separation plate reaches its end, in the setting direction, position in which the volume of the combustion chamber is reduced to a minimum. This can be achieved, e.g., by providing in the cylindrical wall of the combustion chamber, at least one channel or a bypass that communicates the scavenging chamber with an intermediate chamber or chamber of the combustion chamber only in the end, in the setting direction, position of the separation plate.

In order to retain the slide member in its operational position during filling of the scavenging chamber with air, advantageously, a retaining mechanism is provided which releasably retains the slide member in its operational position. For an automatic displacement of the slide member in a direction in which the slide member forces the scavenging air out of the scavenging chamber, a spring is provided. Upon release of the retaining mechanism, the spring biases the slide member in a direction toward the combustion chamber, and the slide member forces the scavenging air from the scavenging chamber and into the combustion chamber.

According to the invention, the retaining mechanism includes at least one locking element that engages a complementary element provided on the slide member in the operational position of the slide member, and a releasing element which can be actuated, e.g., by the separation plate when the separation plate is displaced to its end position at the bottom of the combustion chamber. The actuation of the releasing element results in release of the slide member. These measures provide for automatic scavenging of the combustion chamber after completion of the setting process. The displacement of the slide member to its operational position can, e.g., take place when the setting tool is pressed against a constructional component. The press-on action can be transmitted to the slide member by rods or another appropriate means.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
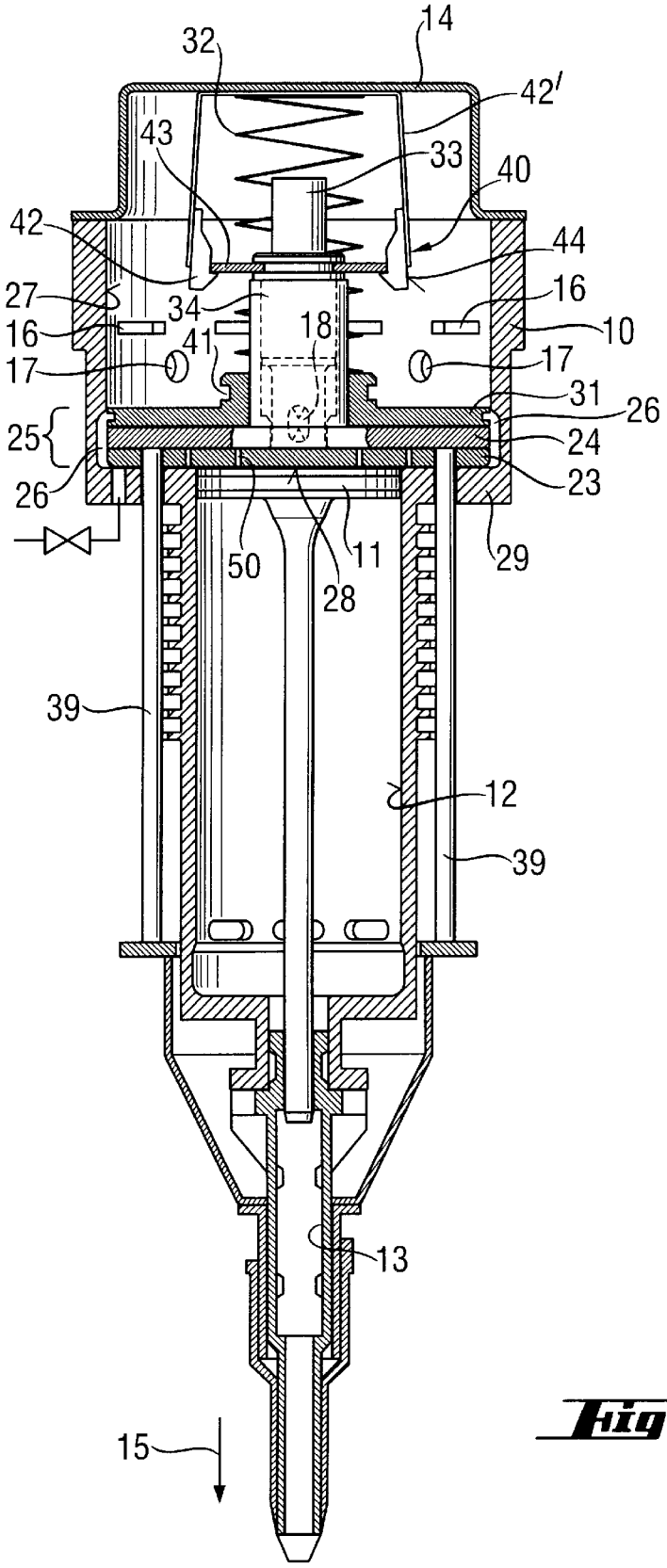
FIG. 1 a longitudinal cross-sectional view of a setting tool according to the present invention in an off-position.
Figure 2:
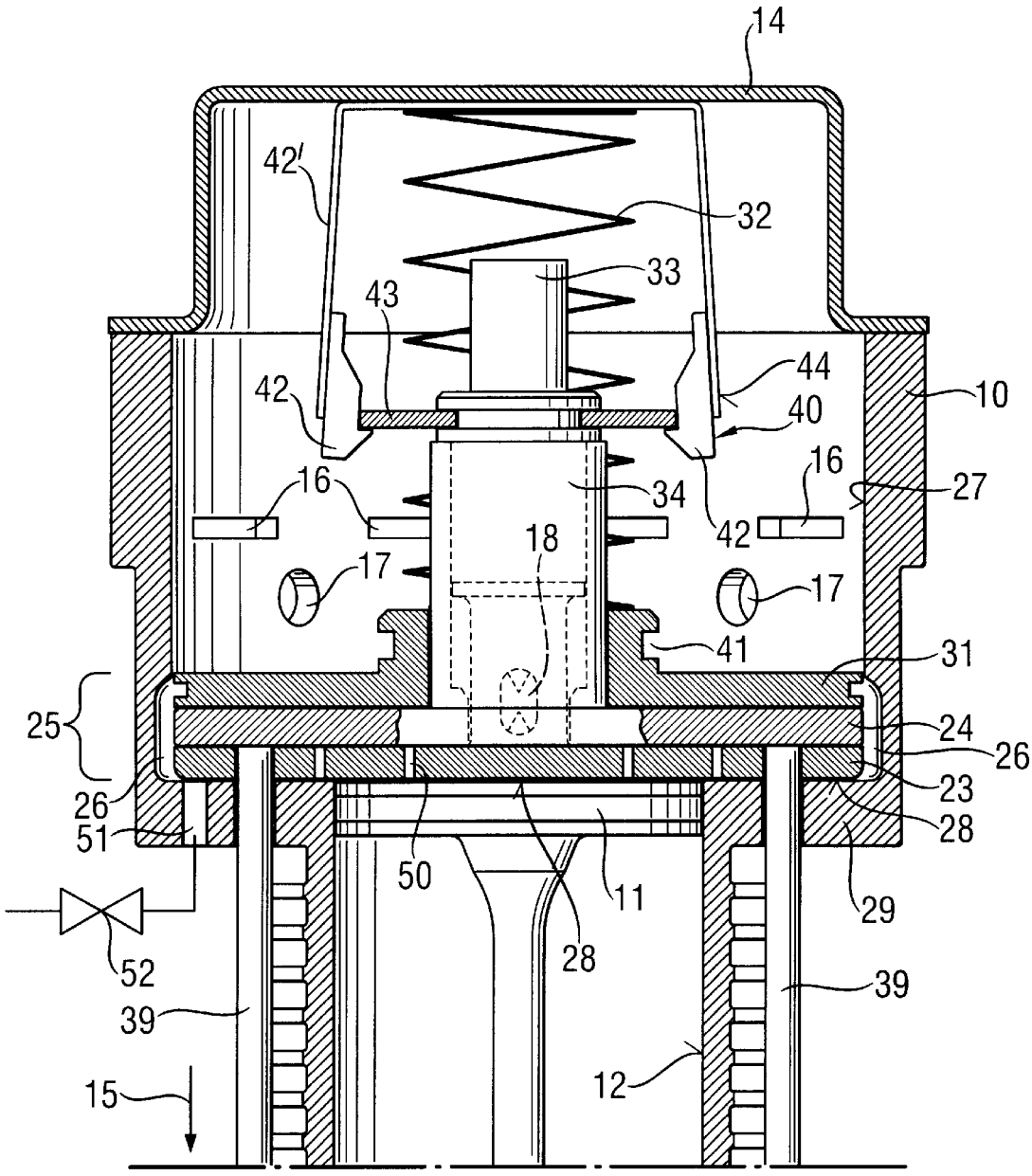
FIG. 2 a cross-sectional view of a portion of the setting tool shown in FIG. 1 at an increased, in comparison with FIG. 1, scale.

A setting tool according to the present invention is shown in FIGS. 1–2 in its off-or initial position. In the embodiment shown in the drawings, the setting tool is operated with fuel gas which is stored in a fuel gas container (not shown). The setting tool has a housing 10 and a setting mechanism located in the housing for driving a fastening element (not shown) into a constructional component (likewise not shown) when the setting tool is pressed against the constructional component and is actuated. A combustion chamber 20 (FIG. 3), a guide cylinder 12, a piston 11 displaceable in the guide cylinder 12, and a bolt guide 13 for the fastening element form parts of the setting mechanism. In the bolt guide 13, the fastening element is displaced by a front, setting direction end of the piston 11 and is driven thereby into the constructional component. The fastening elements are stored in a magazine provided on the setting tool.

The combustion chamber 20 of the inventive setting tool is formed of two section, a first section 21 and a second section 22. In the initial position of the setting tool shown in FIGS. 1–2, the displaceable separation elements 23, 24, which form the chamber section 21, occupy their end position 28 in which they abut each other and are located in the front, in the setting direction 15, section 25 of the combustion chamber 20. In this position of the separation elements 23, 24, the combustion volume is practically equal zero. The space, in which the combustion chamber 20 can be expanded upon displacement of the separation elements 23, 24 is surrounded by a cylindrical chamber wall 27. In the chamber wall 27, there are formed air inlet openings 16 and two fuel inlets 17 (see also FIGS. 3–5). The fuel gas is fed into the chamber 20 through the fuel inlets 17 from the fuel gas container. There is further provided, in the chamber space, a plate-shaped slide member 31 which abuts the separation element 24 the top plate of the combustion chamber 20. In the rear region of the housing 10, there are located hook-shaped locking elements 42 which are supported on spring steel sheets 42'. In FIGS. 1–2, both locking elements 42 are in their release position 44 in which they are located away from each other by a release plate 43 against a biasing force of the spring steel sheets 42'. The release plate 43 is displaceably supported on a guide member 33. The guide member 33 is arranged in a support member 34, which is formed, in the embodiment shown in the drawings, as a support tube, and is displaceable relative thereto. The support member 34 is fixedly secured to the separation element 24 of the combustion chamber 20. Also supported on the support member 34, the slide member 31. Complementary to the hook-shaped locking elements 42, elements 41 are provided on the slide member 31 for displacement therewith. There is further provided, in the rear region of the housing 10, a spring 32 supported at its opposite ends, against a housing bottom 14 and the slide member 31. It should be understood that the setting tool shown in the drawings can have an outer housing, e.g., formed of a plastic material.

Figure 3:
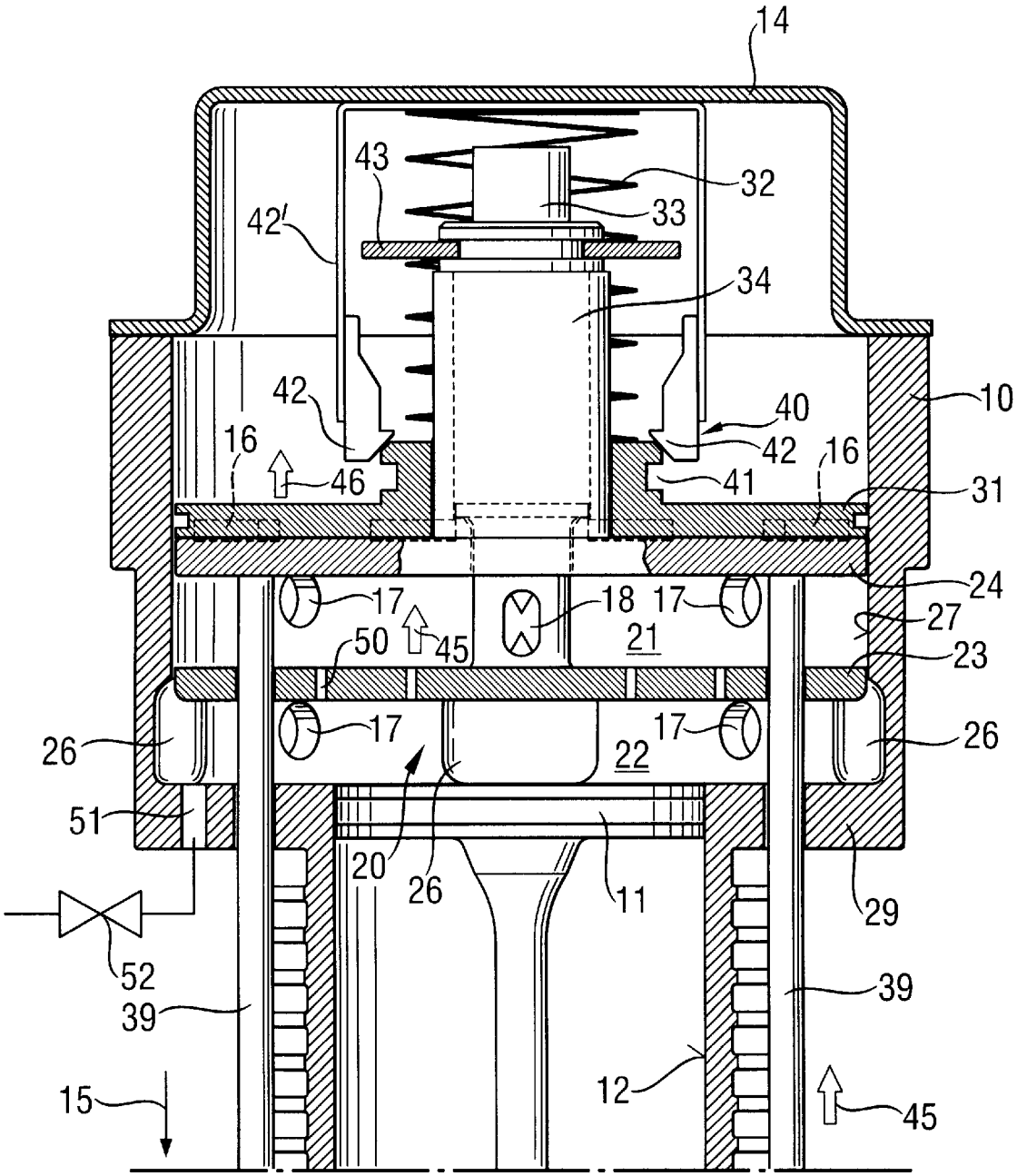
FIG. 3 a cross-sectional of the portion of the setting tool shown in FIG. 2 during the press-on step.

In order to bring the setting tool, which is shown in FIGS. 1–2 from its off-or initial position, into its operational position, the setting tool should be pressed against a constructional component in the setting direction 15. FIG. 3 shows the condition of the rear section of the setting tool during the press-on step. The press-on movement of the setting tool is transmitted with positioning elements 39, e.g., positioning rods to the separation elements 23, 24, which move in a direction shown with an arrow 45. The displacement of the separation elements 23, 24 leads to expansion of the first and second chamber sections 21, 22. The separation element 24 or the top plate carries the slide member 31 which is displaced in a direction indicated with arrow 46 to its operational position. As shown in FIG. 3, an ignition device 18, e.g., a spark plug, is arranged in a cage provided in the first chamber section 21 of the combustion chamber 20. The ignition device 18 provides for ignition of a gas mixture that fills the combustion chamber 20.

Figure 4:
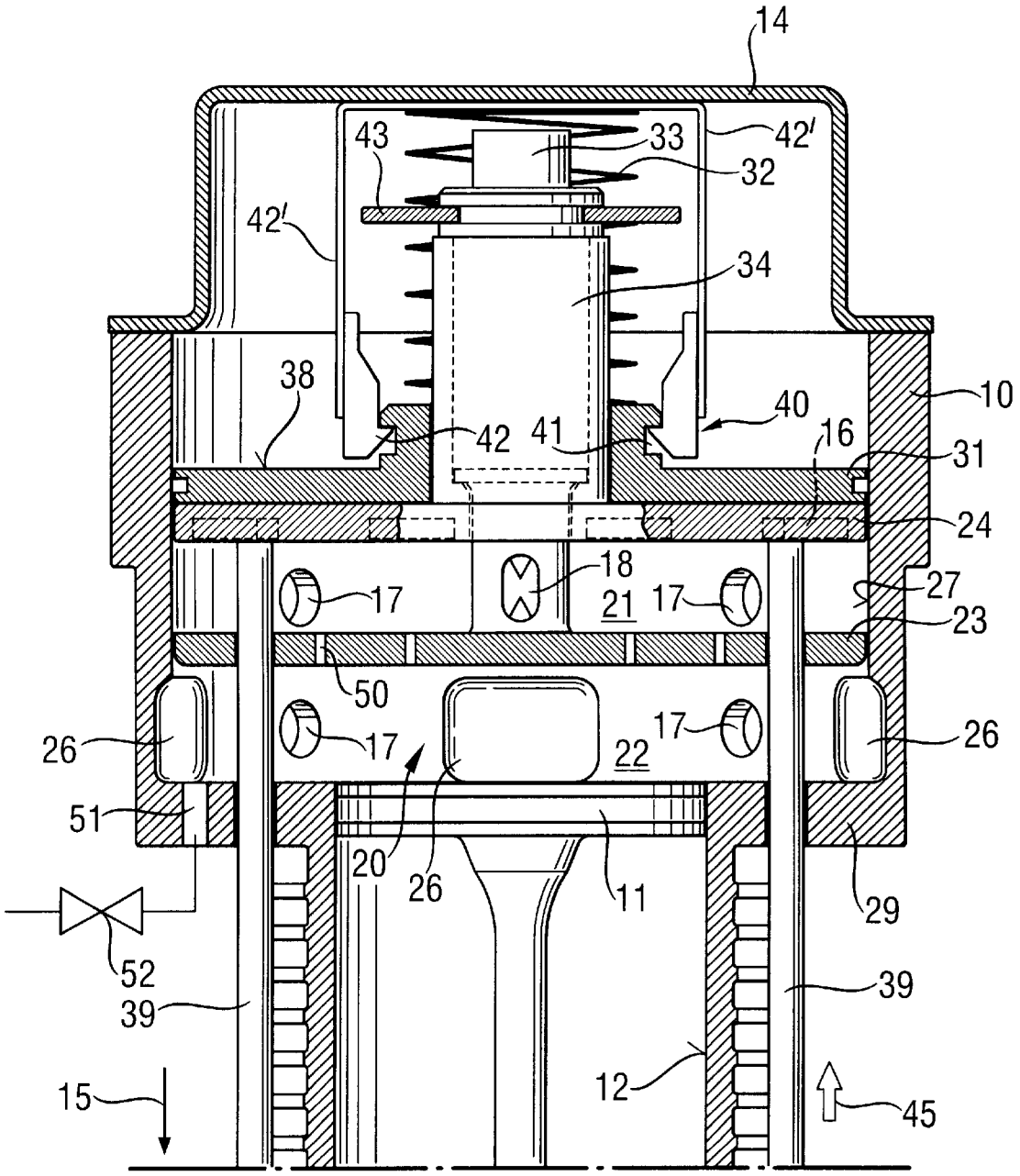
FIG. 4 a cross-sectional view of the portion of the setting tool shown in FIGS. 2–3 in the press-on condition of the setting tool.
Figure 5:
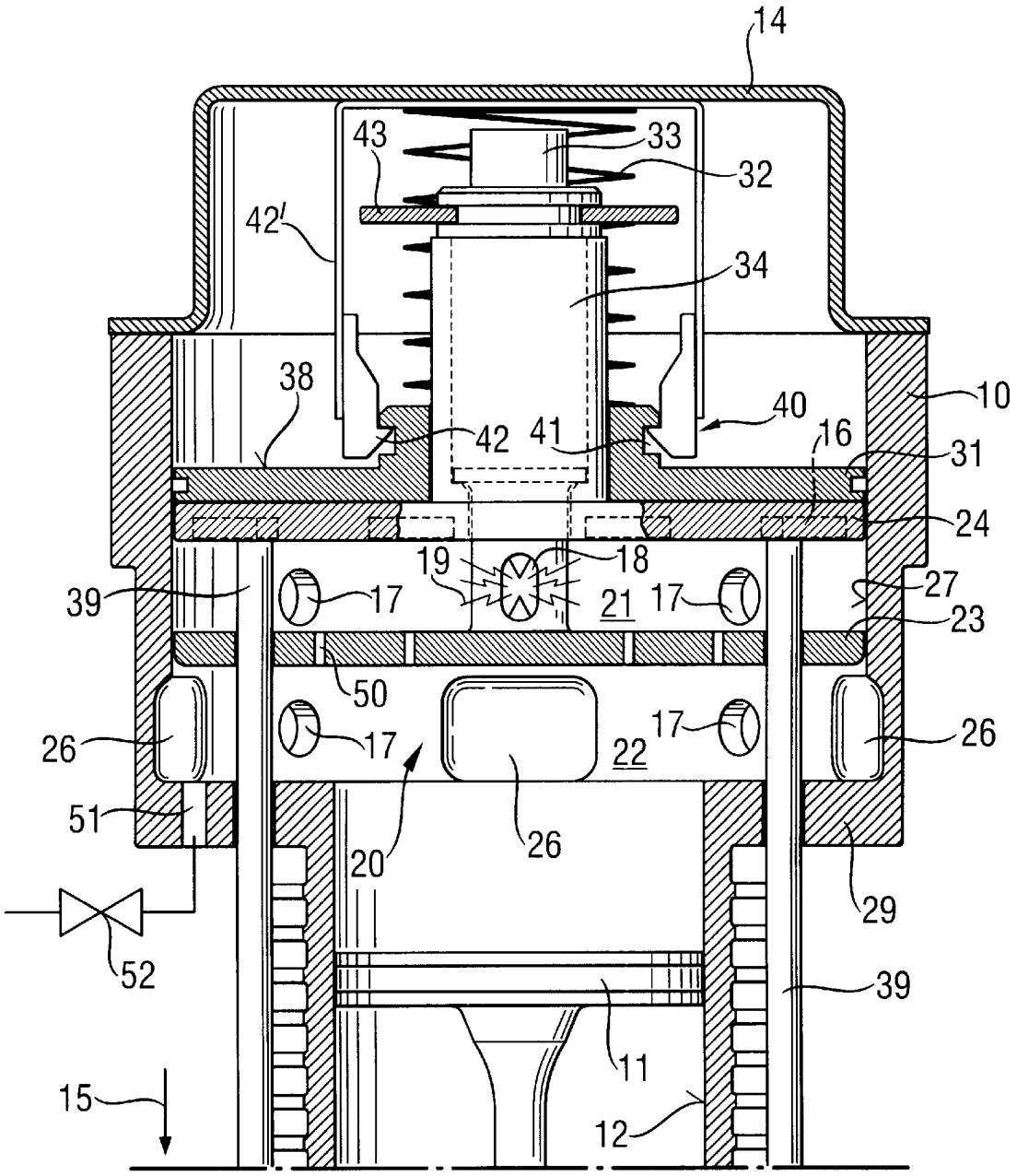
FIG. 5 a cross-sectional view of the portion of the setting tool shown in FIGS. 2–4 in the actuated position of the tool during the ignition step.

During the press-on step, the release plate 43, which is connected with the support member 34, is displaced in a direction toward the housing bottom 14 from its position between the locking elements 42. Simultaneously with the movement of the slide member 31 in the direction of the arrow 46, the spring 32 is loaded. As a result, the guide member 33 is not displaced in the direction toward the housing bottom 14 but rather is slightly displaced into the support member 34. In FIG. 4, the setting tool is in its completely press-on position. The slide member 31 is in its operational position 38 in which the hook-shaped locking elements 42 engage in the complementary elements 41. The elements 42, 41, together with spring steel sheets 42', form a retaining mechanism 40. The separation element 24 is located immediately beneath the slide member 31. The chamber sections 21, 22 are completely expanded, with the separation element 23 located in the middle of the combustion chamber 20. In this position of the setting tool, the fuel or fuel mixture flows through the fuel inlets 17 into the combustion chamber 20 or the combustion chamber sections 21, 22. In this position of the setting tool, later, the piston 11 is located in the region of the bottom 29 of the combustion chamber 20. Upon actuation of the setting tool with a trigger or an actuation button, sparks 19 are produced upon ignition of the ignition device 18, as shown in FIG. 5. Upon ignition, the fuel-air mixture is ignited in the chamber section 21. Through openings 50 in the separation element 23, the burning gas jets are driven by blast pressure into the second combustion chamber section 22 in which in per se known manner, the fuel-air mixture, which is located in the second combustion chamber section 22, is compressed and ignited by the penetrating burning gas jets. The piston 11 is driven in the setting direction 15 by the pressure of the expanding combustion gases, driving a fastening element in a constructional component.

Figure 6:
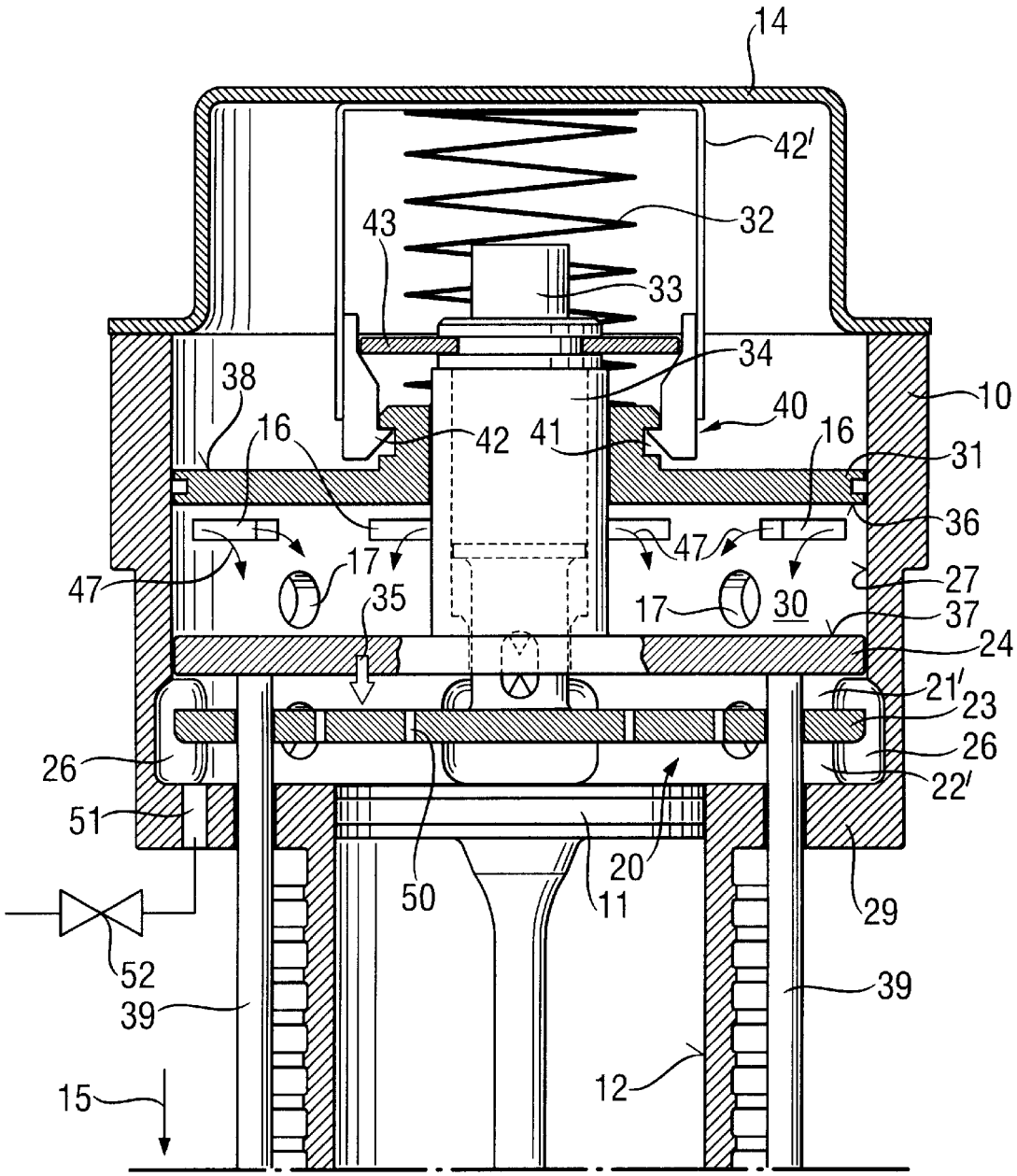
FIG. 6 a cross-sectional view of the portion of the setting tool shown in FIG. 2 in the collapsed position of the combustion chamber sections of the setting tool.

After the setting process is finished, the separation element 24 is displaced in the "collapsing" direction 35 in the scavenging chamber 30 which is formed within the chamber wall 27 between the separation element 24 (its second end 37) and the slide member 31 (its first end 36) (FIG. 6). Likewise, the separation element 23 also moves in the "collapsing direction". The collapse of the separation elements 23, 24 takes place either as a result of cooling of the waste gases of the combustion gases still in the combustion chamber or a result of use of auxiliary means. The collapsing of the combustion chamber 20 and expansion of the scavenging chamber 30 are shown in FIG. 6.

Figure 7:
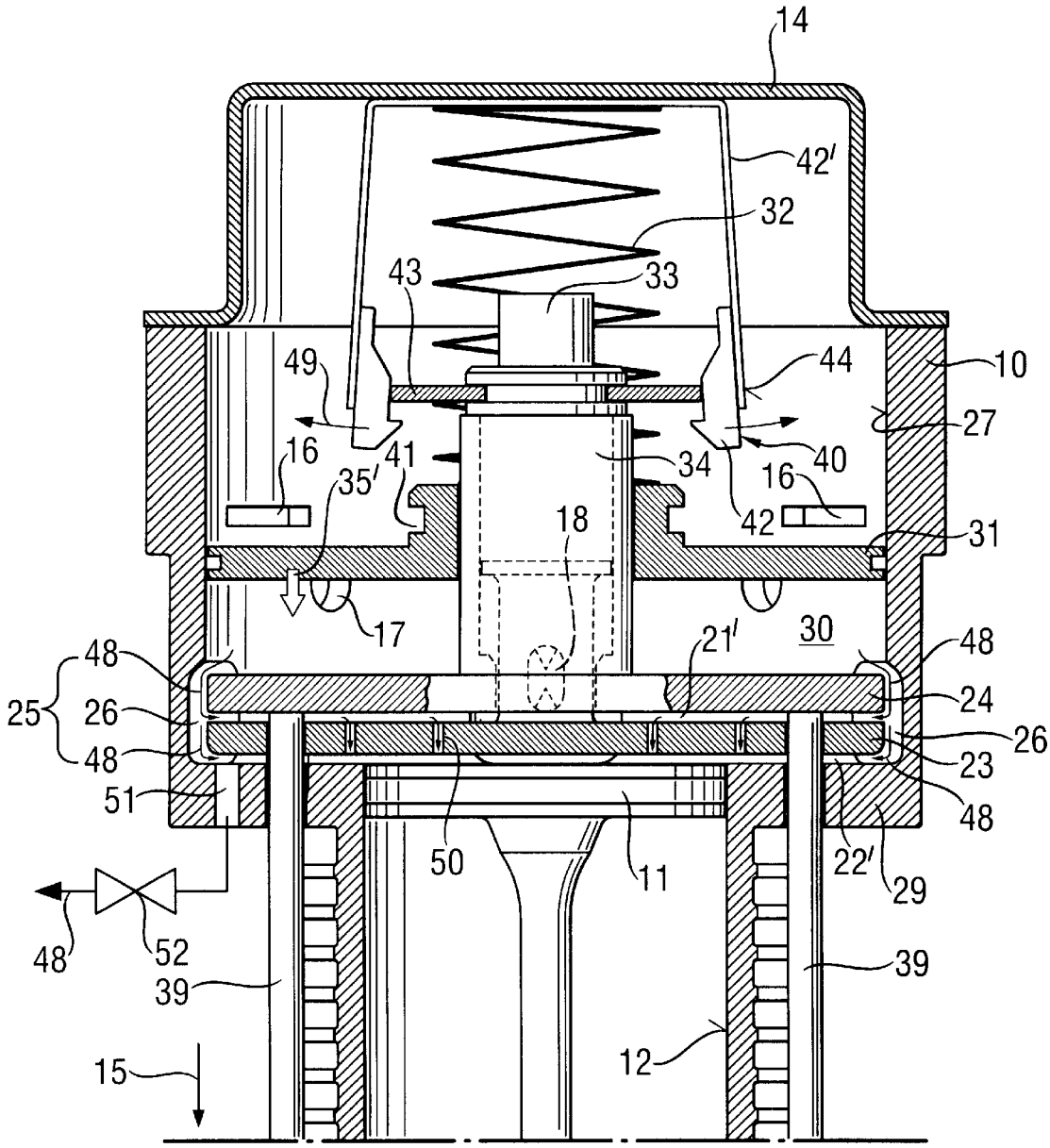
FIG. 7 a cross-sectional view of the portion of the setting tool shown in FIG. 2 with a released scavenging plate.

The combustion gases can be expelled into atmosphere from the combustion chamber through the outlet openings 51 and valves 52 at the bottom 29 of the combustion chamber 20. During the expansion of the scavenging chamber 30, the atmosphere air can enter into the combustion chamber 20 through the air inlet openings 16 in the chamber 27, as shown with arrows 47. Between the collapsing separation elements 24 and 23 and the bottom 29 of the combustion chamber 20, there are formed two intermediate chambers 21' and 22' which occupy only a portion of the original chamber sections 21, 22. When the separation element 24 reaches a predetermined position, the release plate 43 of the retaining mechanism 40 is displaced in its release position 44 in which the two locking elements 42 are displaced thereby in direction of arrows 49 (FIG. 7), whereby the locking elements 42 disengage from their complementary elements 41, e.g., grooves which are formed in the slide member 31. As a result, the slide member 31 is displaced by the biasing force of the spring 32 in the direction of arrow 35', reducing the volume of the scavenging chamber 30 (FIG. 7). The air, which fills the scavenging chamber 30, is expelled through one or several channels 26 from the scavenging chamber 30 in the direction of arrows 48 through the intermediate chambers 21', 22' so that the intermediate chambers 21', 22' are rinsed completely with fresh air, whereby any residues of the waste gases of the combustion are removed therefrom. The rinsing air and the waste gases flow through the air outlet openings 51 and the valves 52. The process lasts until the slide plate 31 reaches its end position above the separation element 24.

When the setting tool is again pressed against a constructional component, the slide plate 31 is again displaced, together with the separation element 23, 24 in the direction opposite the setting direction 15, until the locking elements 42 engage their complementary elements 41 provided in the slide member 31.

The present invention is not limited to the disclosed embodiment. Thus, the scavenging chamber can be provided in a stationary, non-collapsing combustion space. In this case, the slide member should be able to be lifted off the separation element 24 upon the setting tool being pressed against a constructional component by using auxiliary means. By unlocking the slide member 31 after completion the setting process and opening of the corresponding values, a complete rinsing of the combustion chamber can be achieved.

Through the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A gas-operated setting tool for driving fastening elements in a constructional component, comprising:

a combustion chamber (20) in which combustion of an air-fuel mixture takes place;

a guide cylinder (12) adjoining the combustion chamber (20);

a piston (11) displaceable in the guide cylinder (12) under pressure generated as a result of the combustion of the air-fuel mixture in the combustion chamber (20); and means for forming a scavenging chamber (30) adapted to be filled with scavenging air and pneumatically connected with the combustion chamber, the forming means including at least one slide member (31) for discharging the scavenging air from the scavenging chamber toward the combustion chamber (20).

2. A setting tool according to claim 1, comprising at least one separation element for dividing the combustion chamber (20) into two chamber sections (21, 22), wherein a volume of the combustion chamber (20) is reduced at least in one of the chamber sections (21,22) after completion of the combustion process, and wherein the scavenging chamber (30) expands with reduction of the volume of the combustion chamber (20), the scavenging chamber (30) being limited, at its end (36) facing in a direction opposite an expansion direction (35) thereof by the slide member (31) and at its end (37) facing in the expansion direction, by the at least one separation element.

3. A setting tool according to claim 2, wherein the slide member (31) is formed as a plate extending parallel to the at least one separation element.

4. A setting tool according to claim 2, wherein in a section (25) of the combustion chamber (20) facing in a setting direction (15) of the setting tool, at least one channel (26) is formed in a combustion chamber wall (27) and which in a setting direction-side, end position (28) of the at least one separation element (23), is opened, on one hand, toward the scavenging chamber (30) and on another hand, toward an intermediate chamber (21', 22') between the at least one separation element and a bottom (29) of the combustion chamber (20).

5. A setting tool according to claim 2, comprising a spring (32) for biasing the at least one slide member (31) in an operational position (38) in the expansion direction (35') of the scavenging chamber (30); and means for releasably retaining the at least one slide member (31) in the operational position (38) thereof.

6. A setting tool according to claim 5, wherein the retaining means (40) comprises at least one locking element (42) engaging a complementary element (41) provided on the at least one slide member (31) in the operational position (38) of the at least one slide member (31).

7. A setting tool according to claim 6, wherein the retaining means (40) comprises releasing means (43) that displaces the locking element (42) in a release position (44) dependent on a position of the at least one separation element.

8. A setting tool according to claim 1, wherein the slide member (31) is axially displaceably arranged in the setting tool.

9. A setting tool according to claim 8, wherein the locking element (42) is formed as a pivotal hook member.

10. A setting tool according to claim 1, wherein a maximum inner volume of the scavenging chamber (30) is greater than a maximum inner volume of the combustion chamber (20).

* * * * *